US007789075B2

(12) United States Patent
Makino

(10) Patent No.: US 7,789,075 B2
(45) Date of Patent: Sep. 7, 2010

(54) FUEL VAPOR PROCESSING APPARATUS

(75) Inventor: Katsuhiko Makino, Aichi-ken (JP)

(73) Assignee: Aisan Kogyo Kabushiki Kaisha, Obi-shi, Aichi-ken (JP)

( * ) Notice: Subject to any disclaimer, the term of this patent is extended or adjusted under 35 U.S.C. 154(b) by 55 days.

(21) Appl. No.: 12/331,801

(22) Filed: Dec. 10, 2008

(65) Prior Publication Data

US 2009/0151706 A1 Jun. 18, 2009

(30) Foreign Application Priority Data

Dec. 18, 2007 (JP) ..... 2007-325923

(51) Int. Cl.
*F02M 33/04* (2006.01)
*F02M 33/02* (2006.01)

(52) U.S. Cl. ..... 123/519

(58) Field of Classification Search ..... 123/519, 123/520, 516, 518, 198 D; 137/580, 588, 137/589, 43, 493
See application file for complete search history.

(56) References Cited

U.S. PATENT DOCUMENTS 6,003,305 A * 12/1999 Martin et al. ..... 60/274
7,059,306 B2 * 6/2006 Reddy ..... 123/518
2005/0109327 A1 * 5/2005 Reddy ..... 123/519
2007/0113831 A1 * 5/2007 Hoke et al. ..... 123/519

FOREIGN PATENT DOCUMENTS

| | | |
|---|---|---|
| JP | 06 280694 | 10/1994 |
| JP | 11 093783 | 4/1999 |
| JP | 2002 266709 | 9/2002 |
| JP | 3 565789 | 6/2004 |
| JP | 2005 510654 | 4/2005 |
| JP | 2006 77598 | 3/2006 |

OTHER PUBLICATIONS

Clontz et al, "Effects of Low-Purge Vehicle Applications and Ethanol-Containing Fuels on Evaporative Emissions Canister Performance", SAE2007-01-1929, Society of Automotive Engineers of Japan Inc., pp. 1713-1721.

* cited by examiner

*Primary Examiner*—Mahmoud Gimie
(74) *Attorney, Agent, or Firm*—Dennison, Schultz & MacDonald

(57) ABSTRACT

A fuel vapor processing apparatus includes a container and an adsorption member positioned within the container. The adsorption member can adsorb a fuel vapor as a gas containing the fuel vapor flows through the adsorption member. A first electrode and a second electrode are attached to the adsorption member, so that the adsorption member can produce heat as a voltage is applied between the first and second electrodes across the adsorption member. The first and seconds electrodes are spaced from each other in a direction substantially parallel to the direction of flow of the gas through the adsorption member.

10 Claims, 4 Drawing Sheets

FUEL VAPOR PROCESSING APPARATUS

This application claims priority to Japanese patent application serial number 2007-325923, the contents of which are incorporated herein by reference.

BACKGROUND OF THE INVENTION

1. Field of the Invention

The present invention relates to fuel vapor processing apparatus, which can temporarily adsorb fuel vapor and can purge the adsorbed fuel vapor to the engine—when needed. The fuel vapor is contained in a fuel vapor containing gas produced within a fuel tank for an internal combustion engine.

2. Description of the Related Art

A known fuel vapor processing apparatus (also called a canister) has a container filled with granular adsorption material (i.e. activated carbon) for adsorbing and desorbing the vapor contained in the fuel vapor containing gas. A pair of electrodes is positioned on opposite sides of the granular adsorption material (hereinafter simply called "absorption material"). When an electric current is applied for conduction between the electrodes, the adsorption material produces heat that enhances desorption of the vapor (see Japanese Laid-Open Patent Publication No. 6-280694).

Another type of known fuel vapor processing apparatus as disclosed in Japanese Laid-Open Patent Publication No. 2002-266709 has a container in which a cylindrical adsorption member is positioned. The adsorption member can adsorb and desorb the fuel vapor contained in a fuel vapor containing gas and has a honeycomb structure with a plurality of gas passable bores through which fuel vapor containing gas can flow.

With the apparatus of Japanese Laid-Open Patent Publication No. 6-280694, although the adsorption material can produce heat, the adsorption material does not have a honeycomb structure and cannot produce heat. With the apparatus of Japanese Laid-Open Patent Publication No. 2002-266709, although the adsorption member having the honeycomb structure is positioned within the container, the adsorption member cannot produce heat and thus, the desorption of the vapor cannot be enhanced Therefore, there is a need of fuel vapor processing apparatus that has an adsorption member that can be substantially uniformly heated when an electric current is applied between a pair of electrodes.

One aspect according to the present invention includes a fuel vapor processing apparatus that has a container and an adsorption member positioned within the container. The adsorption member can adsorb a fuel vapor as a gas containing the fuel vapor flows through the adsorption member. A first electrode and a second electrode are attached to the adsorption member, so that the adsorption member can produce heat as a voltage is applied between the first and second electrodes across the adsorption member. The first and seconds electrodes are spaced from each other in a direction substantially parallel to the direction of flow of the gas through the adsorption member.

DETAILED DESCRIPTION OF THE INVENTION

Figure 1:
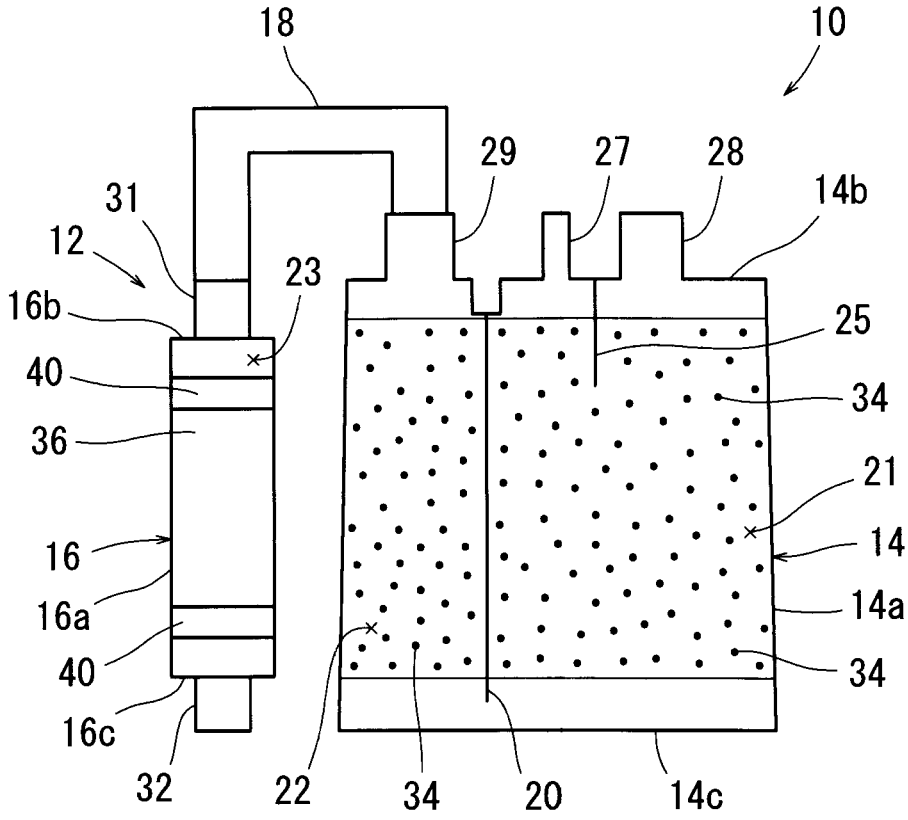
FIG. 1 is a structural view showing a fuel vapor processing apparatus according to a first embodiment of the present invention.

Each of the additional features and teachings disclosed above and below may be utilized separately or in conjunction with other features and teachings to provide improved fuel vapor processing apparatus. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, a fuel vapor processing apparatus includes a container, and an adsorption member positioned within the container and constructed to have a honeycomb structure with a plurality of gas passable bores permitting a fuel vapor containing gas to flow therethrough. The adsorption member can adsorb a vapor contained in a fuel vapor containing gas and can desorb the vapor. A pair of electrodes constructed to apply an electric current to the adsorption material, so that the adsorption member can produce heat. The electrodes are attached along outer peripheral surfaces of opposite end portions or portions proximal to the opposite end portions of the adsorption member. Therefore, the tendencies of increase in temperature at different parts of the adsorption member can be homogenized and the temperature irregularity can be eliminated when the adsorption member produces heat due to application of an electric current for conducting between the electrodes. Accordingly, the efficiency for desorbing the vapor is improved.

In another embodiment, the electrodes are attached to opposite end surfaces of the adsorption member to cover the opposite end surfaces while permitting the fuel vapor containing gas to flow therethrough. Therefore, the tendencies of increase in temperature at different parts of the adsorption member can be homogenized and the temperature irregularity can be eliminated when the adsorption member produces heat due to application of an electric current for conducting between the pair of electrodes. Accordingly, the efficiency for desorbing the vapor is improved.

The electrodes may be mesh-like members jointed to opposite end surfaces in an axial direction of the adsorption member. Accordingly, the electrodes may be easily attached to the opposite end surfaces of the adsorption member.

Alternatively, the electrodes may be films applied to opposite ends surfaces of the adsorption portion. Accordingly, the pair electrodes may be easily attached to the opposite end surfaces of the adsorption member.

In another embodiment, three or more electrodes are used for applying an electric current to the adsorption material, so that the adsorption member can produce heat. The three or more electrodes are attached along an outer peripheral surface of the adsorption member at predetermined intervals in an axial direction. Therefore, the tendencies of increase in temperature at different parts of the adsorption member can be homogenized and the temperature irregularity can be eliminated when the adsorption member produces heat due to application of an electric current for conducting between the electrodes. Accordingly, the efficiency for desorbing the vapor is improved. Further, when ratio of length "L" to diameter "D," i.e. L/D, of the adsorption member is increased, the efficiency of adsorption of vapor may be improved while decreasing electric resistance due to application of electric current for conduction between electrodes next to each other. Therefore, the adsorption member may efficiently produce heat. If the cross sectional configuration of the adsorption member is not circle (e.g. oval, polygonal shape, or irregular shape), the diameter D may be determined by regarding the cross sectional area as the circular cross sectional area.

In a further embodiment, the fuel vapor processing apparatus includes a plural number of the adsorption members serially arranged within the container. Accordingly, the efficiency for adsorbing the vapor is improved. Further, because the space is formed between the adsorption members positioned next to each other, the vapor can be trapped within the space and can be prevented from blowing out of the container, and accordingly, the ejection of the vapor into the atmosphere may be inhibited.

Embodiment 1

A first embodiment of the present invention will now be explained. For the purpose of convenience in explanation, an outline of a fuel vapor processing apparatus will be first described and then various attachment structures of electrodes will be explained. FIG. 1 is a structural view showing the fuel vapor processing apparatus. As shown in FIG. 1, the fuel vapor processing apparatus 10 has a container 12. The container 12 has a main container portion 14, a sub container portion 16 which is a separate portion from the main container portion 14, and a communicating pipe 18 for communicating between the main container portion 14 and the sub container portion 16.

The main container portion 14 is formed to have a box-like configuration having a hollow cylindrical side wall portion 14*a*, a top wall portion 14*b* for closing an upper opening of the side wall portion 14*a*, and a bottom wall portion 14*c* for closing a lower opening of the side wall portion 14*a*. The main container portion 14 is divided into a first chamber 21 and a second chamber 22 disposed on the right side and the left side, respectively, by a first partition wall 20 extending from the top wall portion 14*b* to a position proximal to the bottom wall portion 14*c*. The first chamber 21 and the second chamber 22 communicate with each other via a gap produced between the first partition wall and the bottom wall portion 14*c*.

The sub container portion 16 has a hollow cylindrical wall portion 16*a*, a top end wall portion 16*b* and a bottom end wall portion 16*c*. A third chamber 23 is defined inside the sub container portion 16. The upper space of the first chamber 21 is divided into right and left parts by a second partition wall 24 extending from the upper wall portion 14*b* towards the bottom end.

A purge port 27 is formed on the top wall portion 14*b* of the first chamber 21 and communicates with the left side upper space of the first chamber. A purge passage (not shown) for communicating with an intake air pipe of an engine is connected to the purge port 27. A purge control valve is disposed in a midstream of the purge passage. The purge control valve is controlled by a control device during operation of the engine, so that a purge control relating to desorption of the vapor can be performed as will be explained later.

The top wall portion 14*b* of the first chamber 21 has a tank port 28 communicating with the upper right space of the first chamber 21. A fuel vapor containing gas passage (not shown) communicating with a gaseous phase region of a fuel tank is connected to the tank port 28. Therefore, the fuel vapor containing gas produced within the fuel tank can be introduced into the first chamber 21 via the fuel vapor containing gas passage and the tank port 28. The fuel vapor containing gas containing fuel vapor is a gaseous mixture consisting mainly of hydrocarbon compound gas and air. In this specification, the term "vapor" is used to mean the hydrocarbon compound gas.

A connecting port 29 communicating with the second chamber 22 is formed on the top wall portion 14*b* of the second chamber 22. A connecting port 31 communicating with the third chamber 23 is formed on the upper end wall portion 16*b* of the sub container 16. The connecting port 29 of the main container portion 14 is connected to one end of the communicating pipe 18 and the connecting port 31 of the sub container portion 16 is connected to the other end of the communicating pipe 18. In this way, the second chamber 22 and the third chamber 23 communicate with each other via the communicating pipe 18. An atmospheric port 32 is formed on the bottom end wall portion 16*c* of the sub container portion 16. An atmospheric passage (not shown) for communicating with the atmosphere is connected to the atmospheric port 32.

Each of the first chamber 21 and the second chamber 22 is filled with an adsorption material 34 in the form of particles made of activated carbon. The adsorption material 34 can adsorb the vapor contained in the fuel vapor containing gas that is introduced into the first chamber 21 and the second chamber 22 via the tank port 28. The adsorption material 34 may be granulated carbon, commuted carbon etc. Horizontally arranged plate-like grids (not shown) are resiliently supported on the bottom wall portion 14*c* via resilient members, such as coil springs, so as to be positioned at the bottoms of the each chambers 21 and 22. Accordingly, a space is formed between the bottom wall portion 14*c* and the grids. In each upper space of the first chamber 21 and the second chamber 22, a horizontally arranged filter is positioned in such a manner as it covers the upper surface of the adsorption material 34. Accordingly, a space is defined between the upper wall portion 14*b* and each filter.

Figure 2:
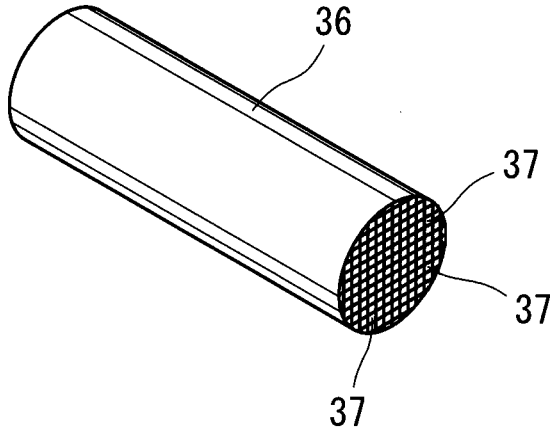
FIG. 2 is a perspective view showing an adsorption member.

An adsorption member 36 having a honeycomb structure is positioned within the third chamber 23. FIG. 2 is a perspective view showing the adsorption member 36. As shown in FIG. 2, the adsorption member 36 has a cylindrical configuration and has a plurality of gas passable bores 37 extending in an axial direction (a vertical direction in FIG. 1). The adsorption member 36 can absorb and desorb the vapor contained in the fuel vapor containing gas as the fuel vapor containing gas flows through the gas passable bores 37. Although each of the gas passable bores 37 has a rectangular cross section in this embodiment, the gas passable bore 37 may have any other cross sectional configuration than a rectangular cross section. For example, the cross section of the gas passable bore 37 may be hexagonal, circular or any other configuration. Thus, in this specification, the term "honeycomb structure" is broadly used to mean a structure having a plurality of gas passable bores, and the cross sectional configuration of each bore is not limited to a particular configuration. The adsorption member 36 may be made of a mixture at a predetermined ratio of a material having a high heat capacity, such as ceramic, and an adsorption material, such as activated carbon. Then, the mixture molded to have a predetermined configuration (e.g. a cylindrical configuration) and is thereafter fired. Spaces are formed between end wall portions 16*b* and 16*c* of the sub container 16 and end surfaces of the adsorption member 36 opposing to the end wall portions 16*b* and 16*c*, respectively (see FIG. 1).

The operation of the fuel vapor processing apparatus 10 (see FIG. 1) will now be explained. The fuel vapor containing gas produced within the fuel tank is introduced into the first chamber 21 via the tank port 28 of the man container portion 14. The fuel vapor containing gas introduced into the first chamber 21, passes through gaps between particles of the adsorption material 34 disposed within the first chamber 21, and flows into the second wall portion 22. Then, the fuel vapor containing gas flown into the second chamber 22 passes through gaps between particles of the adsorption material 34 and flows into the third chamber 23 of the sub container portion 16 via the communication pipe 18. The fuel vapor containing gas flown into the third chamber 23 passes through the gas passable bores 37 of the adsorption member 36 and is then discharged into the atmosphere via the atmospheric port 32. As the fuel vapor containing gas flows in this way, the vapor is adsorbed by the adsorption material 34 of the main container 14. The rest of the vapor is adsorbed by the adsorption member 36 disposed inside of the sub-container portion 16. Eventually the gas or the air that does not substantially contain the fuel composition is discharged into the atmosphere via the atmospheric port 32.

When a purge control is performed during the operation of the engine, the negative pressure inside the intake air pipe is introduced into the first chamber 21 via the purge port 27 of the main container portion 14. Accordingly, air in the atmosphere is drawn into the third chamber 23 via the atmospheric port 32. The air introduced into the third chamber 23 passes through the gas passable bores 37 of the adsorption member 36, and then passes through the gaps between the particles of the adsorption material 34 within the second chamber 22 of the main container portion 14 via the communicating pipe 18. Further, the air passes through the gaps between the particles of the adsorption material 34 inside of the first chamber 21 and then flows from the purge port 27 into the intake air pipe via the purge passage. Accordingly, the vapor is desorbed from the adsorption material 34 and the adsorption member 36, and then flows into the intake air path.

The fuel vapor processing apparatus 10 has a pair of electrodes 40 attached to the adsorption member 36. The electrodes 40 is used for applying an electric current across the adsorption member 36 to generate heat by the adsorption member 36 under a predetermined condition (e.g. the purging condition) during the engine operation.

Figure 3:
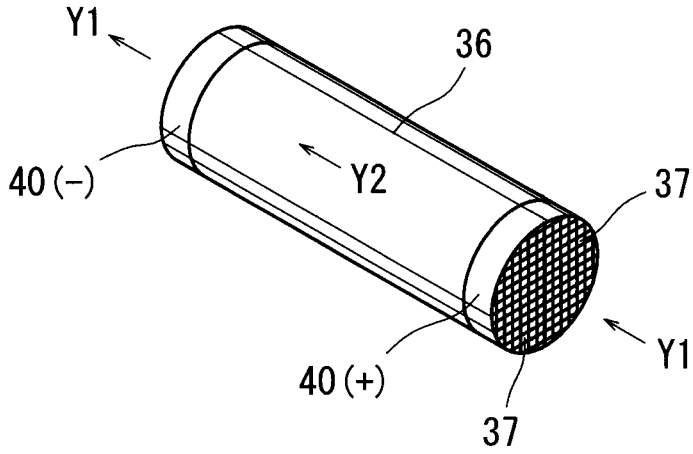
FIG. 3 is a perspective view showing an attaching structure of electrodes to the adsorption portion.

The structure for attaching the electrodes 40 to the adsorption member 36 will now be explained. FIG. 3 is a perspective view showing the structure for attaching the electrodes 40 to the adsorption member 36. As shown in FIG. 3, the electrodes 40 attached along the outer peripheral surfaces of opposite ends of the adsorption member 36 in the direction of flow of the fuel vapor containing gas, i.e., an axial direction of the adsorption member 36. Each of the electrodes 40 is made of a strip-like material having a low electrical resistance (e.g., a copper foil). Each electrode 40 is wrapped around the outer peripheral surface of the corresponding end of the adsorption member 36 and is adhered thereto by adhesive agent having electrical conductivity. Provided that the electrode 40 on the upstream side (the side of the atmospherics port 32) with respect to the flow of air during the purging operation (see arrow Y1 in FIG. 3) is a + (positive) electrode and the electrode 40 on the downstream side (the side of the connecting port 31) is a – (negative) electrode and that a voltage is applied between the electrodes 40, an electric current flows from the + electrode side to the – electrode side of the adsorption member 36 having the electrical resistance (see, arrow Y2 in FIG. 3). Due to this, the adsorption member 36 produces heat. In this embodiment, the electrode 40 on the upstream side (the side of the atmospherics port 32) with respect to the flow of air during the purging operation is provided as the + electrode and the electrode 40 on the downstream side (the side of the connecting port 31) is provided as the – electrode. However, it is possible to provide the electrode 40 on the upstream side as the – electrode and the electrode 40 on the downstream side electrode as the + electrode.

According to the fuel vapor processing apparatus 10, the electrodes 40 is positioned along the outer peripheral surfaces of the opposite ends of the adsorption member 36. Therefore, the tendencies of increase in temperature at different parts of the adsorption member can be homogenized and the temperature irregularity can be eliminated when the adsorption member 36 produces heat due to application of an electric current for conducting between the electrodes 40. Accordingly, the efficiency for desorbing the vapor is improved. Although the electrodes 40 are attached along the outer peripheral surfaces of opposite ends of the adsorption member 36 in this embodiment, the electrodes 40 may be attached along the outer peripheral surfaces of portions of the adsorption member 36, which are positioned away from the opposite ends toward the center of the adsorption member 36 by a little distance. In other words, the electrodes 40 may be spaced from opposite end surfaces of the adsorption member 36.

The electrodes 40 may be coated-films that are made of metal, such as copper, having a low electric resistance and are attached along the outer peripheral surfaces of the end portions of the adsorption member 36 by a film forming process, such as a plating process. In this case, the electrodes 40 may be easily attached to the outer peripheral surfaces of the opposite end portions of the adsorption member 36.

The fuel vapor processing apparatus 10 (see FIG. 1) may be constituted only with the sub container portion 16 including the adsorption portion 36, and therefore, the main container portion 14 and the communicating pipe 18 can be omitted. Second to seventh embodiments will now be described with reference to FIGS. 4 to 9. These embodiments are modifications of the first embodiment. Therefore, in FIGS. 4 to 9, like members are given the same reference numerals as the first embodiment and the description of these members will not be repeated.

Embodiment 2

Figure 4:
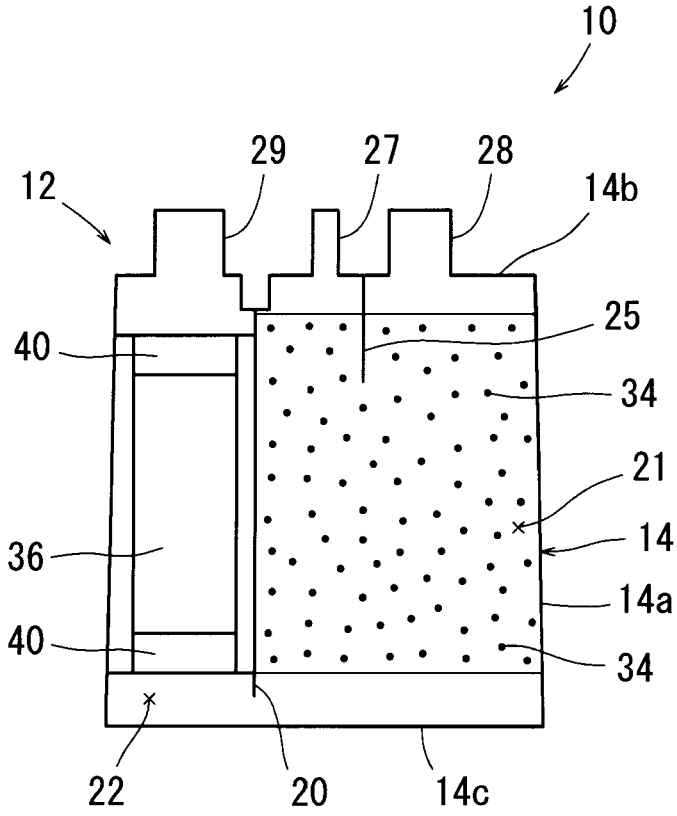
FIG. 4 is a structural view showing a fuel vapor processing apparatus according to a second embodiment of the present invention.

A second embodiment will be described with reference to FIG. 4 that is a structural view showing the fuel vapor processing apparatus. As shown in FIG. 4, the fuel vapor processing apparatus 10 of this embodiment does not include the sub container portion 16 and the communicating pipe 18 that are included in the fuel vapor processing apparatus 10 of the first embodiment. In this embodiment, the connecting port 29 of the main container portion 14 of the first embodiment is used as an atmospheric port 29 (the same numerical number is allocated). Further, in this embodiment, the adsorption member 36 (see FIG. 3) having the electrodes 40 is disposed within the second chamber 22 of the main container 14 instead of the adsorption material 34. Therefore, the fuel vapor containing gas may flow within the second chamber 22 by passing through a plurality of gas passable bores 37 (see FIG. 2) of the adsorption member 36.

Embodiment 3

Figure 5:
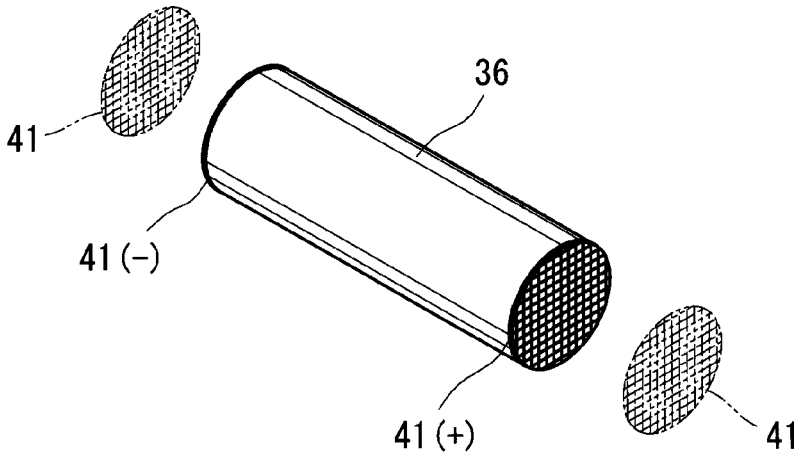
FIG. 5 is a perspective view showing an attaching structure of electrodes to an adsorption member according to a third embodiment of the present invention.

A third embodiment will now be described. This embodiment is different from the first embodiment in the attaching structure of the electrodes to the adsorption member of the first embodiment. FIG. 5 is a perspective view showing the attaching structure of electrodes to the adsorption member. As shown in FIG. 5, a pair of electrodes (numerical number 41 is allocated) is attached to the opposite end surfaces in the axial direction of the adsorption member 36 such that the electrodes 41 cover the opposite end surfaces while the electrodes permit the fuel vapor containing gas to flow therethrough. Each of the electrodes 41 is a circular disk-like mesh member made of metal having low electrical resistance (e.g. copper). The electrodes 41 are adhered, in other words, bonded to the opposite end surfaces of the adsorption member 36 with an electrically conductive adhesive agent. According to this embodiment, because the electrodes 41 are made of the mesh members bonded to the opposite end surfaces in the axial direction of the adsorption member 36, the electrodes 41 is easily attached to the opposite end surfaces of the adsorption member 36. In FIG. 5, the electrodes 41 prior to attachment to the adsorption member 36 are shown with two dotted chain lines.

Embodiment 4

Figure 6:
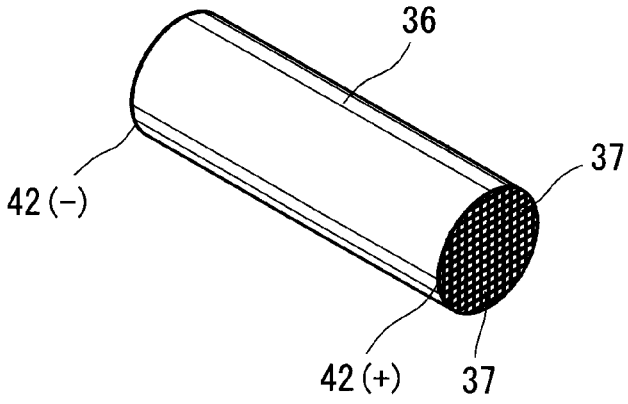
FIG. 6 is a perspective view showing an attaching structure of electrodes to an adsorption member according to a fourth embodiment of the present invention.

A fourth embodiment will now be explained. This embodiment is a modification of the attaching structure of the electrodes 41 to the adsorption member of the third embodiment. FIG. 6 is a perspective view showing the attaching structure of electrodes to the adsorption member according to the fourth embodiment. As shown in FIG. 6, instead of the electrodes 41 formed of mesh members in the third embodiment, a pair of electrodes (numerical number 42 is allocated) is formed of films applied to the opposite end surfaces of adsorption member 36. More specifically, the electrodes 42 are formed on the opposite end surfaces of the adsorption member 36 (specifically, the end surfaces of walls having the gas passable bores 37) by applying metal material having low electrical resistance (e.g. copper material) by a film forming process such as a plating process. According to this embodiment, the electrodes 42 is formed of films. Therefore, the electrodes 42 may be easily attached to the opposite end surfaces of the adsorption member 36.

Embodiment 5

Figure 7:
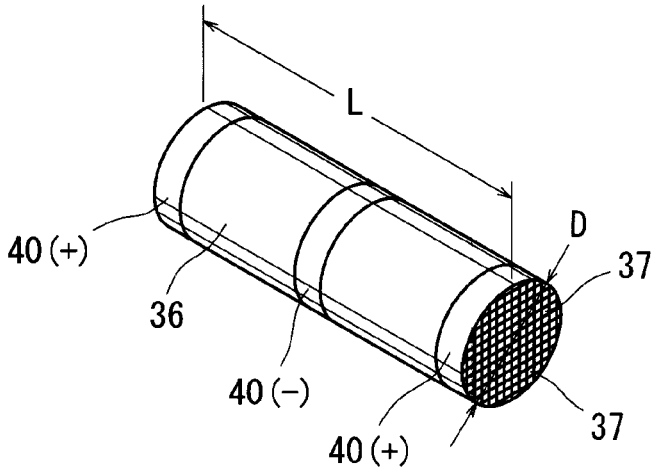
FIG. 7 is a perspective view showing an attaching structure of electrodes to an adsorption member according to a fifth embodiment of the present invention.

A fifth embodiment will now be explained. This embodiment is a modification of the attaching structure for attaching the electrodes to the adsorption member of the first embodiment. FIG. 7 is a perspective view showing an attaching structure of the electrodes to the adsorption member according to the fifth embodiment. As shown in FIG. 7, this embodiment incorporates one additional electrode 40 attached to the outer peripheral surface of the central portion of the adsorption portion 36 of the first embodiment having the electrodes 40. Therefore, three electrodes 40 are attached along the outer peripheral surface of the adsorption member 36 at pre-determined intervals in the axial direction. Provided that the electrodes 40 attached to the opposite ends are + electrodes and the electrode 40 attached to the center is a – electrode, and a voltage is applied between each two electrodes 40 positioned next to each other, the electric current flows from the sides of the + electrodes to the side of the – electrode. Accordingly, the adsorption member 36 produces heat. With this embodiment, it is possible to improve the efficiency for adsorbing the vapor by increasing the ratio of length (the length of the axial direction) L to diameter D of the adsorption member 36 (i.e., L/D ratio), while it is possible to effectively produce heat because due to reduction of the electric resistance produced between each two electrodes 40 positioned next to each other when the electric current is applied. The number of the electrode 40 is not limited to three but could be four or more than four.

Embodiment 6

Figure 8:
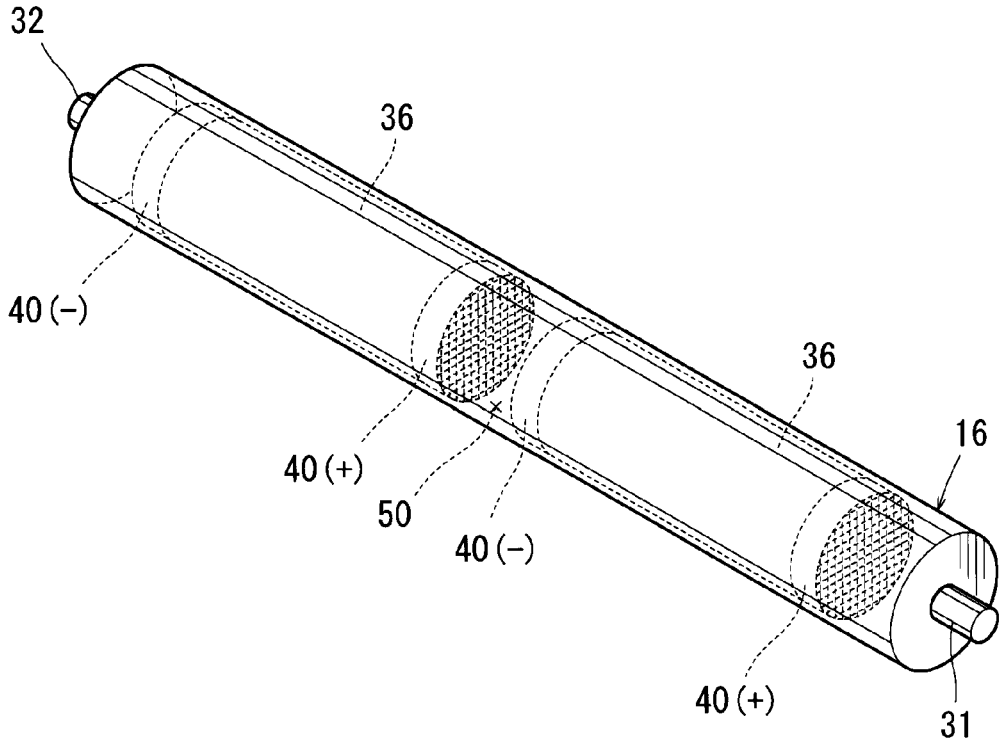
FIG. 8 is a structural view showing a fuel vapor processing apparatus according to a sixth embodiment of the present invention.

A sixth embodiment will now be explained. FIG. 8 is a perspective view showing a fuel vapor processing apparatus of the sixth embodiment. As shown in FIG. 8, two adsorption members 36 are serially arranged within the sub container portion 16. A space 50 is formed between the adsorption members 36 positioned next to each other. With this embodiment, it is possible to improve the efficiency for adsorbing the vapor. Further, because the space 50 is formed between the adsorption members 36 positioned next to each other, the vapor can be trapped within the space 59 and can be prevented from blowing out of the sub container portion 16, and accordingly, the ejection of the vapor into the atmosphere may be inhibited. However, the space 50 formed between the adsorption members 36 positioned next to each other may be omitted. In addition, three or more adsorption members 36 may be serially positioned.

Embodiment 7

Figure 9:
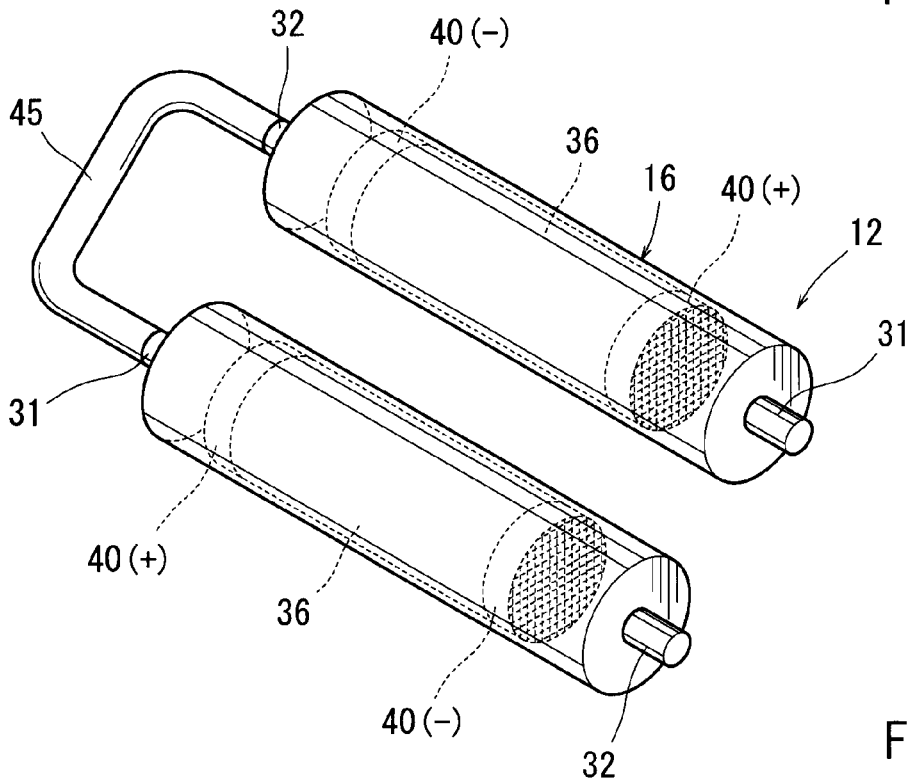
FIG. 9 is a structural view showing a fuel vapor processing apparatus according to a seventh embodiment of the present invention.

A seventh embodiment will now be described. FIG. 9 is a structural view showing a fuel vapor processing apparatus according to the seventh embodiment. As shown in FIG. 9, two sub containers 16 each having the adsorption members 36 are incorporated. The sub containers 16 are serially connected in a turnback manner via a connecting hose 45. With this embodiment, the same operation and effect as the sixth embodiment may be achieved. In addition, the fuel vapor processing apparatus having the two adsorption materials 36 can be compactly constituted.

This invention claims:

1. A fuel vapor processing apparatus comprising:

a container;

an adsorption member positioned within the container and constructed to have a honeycomb structure with a plurality of gas passable bores permitting a fuel vapor containing gas to flow therethrough, wherein the adsorption member can adsorb a vapor contained in a fuel vapor containing gas and can desorb the vapor; and a pair of electrodes constructed to apply an electric current to the adsorption material, so that the adsorption member can produce heat;

wherein the electrodes are attached along outer peripheral surfaces of portions proximal to opposite end portions of the adsorption member.

2. The fuel vapor processing apparatus as defined in claim 1, comprising a plural number of the adsorption members serially arranged within the container.

3. The fuel vapor processing apparatus as defined in claim 1, wherein the adsorption member has a block shape, and wherein the gas passable bores are opened at opposite end portions of the adsorption member but are not opened at an outer peripheral surface of the adsorption member.

4. A fuel vapor processing apparatus comprising:

a container;

an adsorption member positioned within the container and constructed to have a honeycomb structure with a plurality of gas passable bores permitting a fuel vapor containing gas to flow therethrough, wherein the adsorption member can adsorb a vapor contained in a fuel vapor containing gas and can desorb the vapor; and a pair of electrodes constructed to apply an electric current to the adsorption material, so that the adsorption member can produce heat;

wherein the electrodes are attached to opposite end surfaces of the adsorption member to cover the opposite end surfaces while permitting the fuel vapor containing gas to flow therethrough;

wherein the electrodes comprise mesh-like members joined to opposite end surfaces in an axial direction of the adsorption member.

5. The fuel vapor processing apparatus as defined in claim 4, comprising a plural number of the adsorption members serially arranged within the container.

6. The fuel vapor processing apparatus as defined in claim 4, wherein the adsorption member has a block shape, and wherein the gas passable bores are opened at opposite end portions of the adsorption member but are not opened at an outer peripheral surface of the adsorption member.

7. A fuel vapor processing apparatus comprising:

a container;

an adsorption member positioned within the container and constructed to have a honeycomb structure with a plurality of gas passable bores permitting a fuel vapor containing gas to flow therethrough, wherein the adsorption member can adsorb a vapor contained in a fuel vapor containing gas and can desorb the vapor; and a pair of electrodes constructed to apply an electric current to the adsorption material, so that the adsorption member can produce heat;

wherein the electrodes are attached to opposite end surfaces of the adsorption member to cover the opposite end surfaces while permitting the fuel vapor containing gas to flow therethrough;

wherein the electrodes comprise films applied to opposite ends surfaces of the adsorption member; and wherein the films cover the entire opposite end surfaces of the adsorption member except for openings of the plurality of gas passable bores.

8. The fuel vapor processing apparatus as defined in claim 7, wherein the adsorption member has a block shape, and wherein the gas passable bores are opened at opposite end portions of the adsorption member but are not opened at an outer peripheral surface of the adsorption member.

9. A fuel vapor processing apparatus comprising:

a container;

an adsorption member positioned within the container and constructed to have a honeycomb structure with a plurality of gas passable bores permitting a fuel vapor containing gas to flow therethrough, wherein the adsorption member can adsorb a vapor contained in a fuel vapor containing gas and can desorb the vapor; and three or more electrodes constructed to apply an electric current to the adsorption material, so that the adsorption member can produce heat;

wherein the electrodes are attached along an outer peripheral surface of the adsorption member at pre-determined intervals in an axial direction.

10. The fuel vapor processing apparatus as defined in claim 9, comprising a plural number of the adsorption members serially arranged within the container.

* * * * *